US012679504B2

(12) United States Patent
Hao et al.

(10) Patent No.: US 12,679,504 B2
(45) Date of Patent: Jul. 14, 2026

(54) PRESSURE-RESISTANT CABIN FOR DEEP-SEA MOBILE OPERATION APPARATUS, UNDERWATER MINING VEHICLE, AND UNDERWATER MOBILE ROBOT

(71) Applicants: SHENZHEN WELLREACH AUTOMATION CO. LTD, Shenzhen (CN); SHENZHEN KUMPONG INTELLIGENT EQUIPMENT MANUFACTURING CO., LTD, Shenzhen (CN)

(72) Inventors: Fuqiang Hao, Shenzhen (CN); Jiya Zhang, Shenzhen (CN)

(73) Assignees: SHENZHEN WELLREACH AUTOMATION CO. LTD, Shenzhen (CN); SHENZHEN KUMPONG INTELLIGENT EQUIPMENT MANUFACTURING CO., LTD, Shenzhen (CN)

( * ) Notice: Subject to any disclaimer, the term of this patent is extended or adjusted under 35 U.S.C. 154(b) by 299 days.

(21) Appl. No.: 18/703,376

(22) PCT Filed: Apr. 7, 2023

(86) PCT No.: PCT/CN2023/087011
§ 371 (c)(1),
(2) Date: Apr. 22, 2024

(87) PCT Pub. No.: WO2023/197958
PCT Pub. Date: Oct. 19, 2023

(65) Prior Publication Data

US 2024/0409186 A1 Dec. 12, 2024

(30) Foreign Application Priority Data

Apr. 13, 2022 (CN) ..... 202210383355.8

(51) Int. Cl.
*B63B 3/13* (2006.01)
*B63C 11/52* (2006.01)

(52) U.S. Cl.
CPC ..... *B63B 3/13* (2013.01); *B63C 11/52* (2013.01)

(58) Field of Classification Search
CPC ..... B63B 3/16
See application file for complete search history.

(56) References Cited

U.S. PATENT DOCUMENTS

| | | | | |
|---|---|---|---|---|
| 8,464,745 | B1 * | 6/2013 | Ringer | G05D 16/10 166/356 |
| 2013/0167962 | A1 * | 7/2013 | Skjetne | E21B 43/01 138/30 |
| 2016/0215913 | A1 * | 7/2016 | Knoener | H01F 27/14 |

FOREIGN PATENT DOCUMENTS

| | | |
|---|---|---|
| CN | 101034594 A | 9/2007 |
| CN | 201235921 Y | 5/2009 |

(Continued)

*Primary Examiner* — Richard G Davis
(74) *Attorney, Agent, or Firm* — EAGLE IP LIMITED

(57) ABSTRACT

The present invention discloses a pressure cabin for a deep-sea mobile operation device, an underwater mining vehicle, and an underwater mobile robot. The pressure cabin comprises: a first chamber and a second chamber that are sealed, wherein the first chamber is configured to accommodate electrical functional components of the mobile operation device, the second chamber is configured to arrange pressure compensators, and the first chamber and the second chamber are in communication with each other through a pipeline controlled by a solenoid valve; the first chamber and the second chamber each are filled with a liquid insulating material; a housing of the first chamber is made of a pressure-resistant metal, and has a pressure load of 35 Mpa; and the pressure compensators in the second chamber adjust an internal pressure of the second chamber based on (Continued)

a depth of the device submerging in water, and when the solenoid valve of the first chamber is open, the pressure in the first chamber in communication with the second chamber through the pipeline can also be adjusted accordingly. According to the present invention, the pressure cabin effectively reduces an overall weight and size of the device, facilitates movement of the device in deep sea, and also reduces costs.

10 Claims, 2 Drawing Sheets

(56) References Cited

FOREIGN PATENT DOCUMENTS

| | | | | |
|---|---|---|---|---|
| CN | 102897304 | A | | 1/2013 |
| CN | 103188904 | A | | 7/2013 |
| CN | 105432574 | A | | 3/2016 |
| CN | 205743845 | U | | 11/2016 |
| CN | 109798118 | A | | 5/2019 |
| CN | 110379592 | A | | 10/2019 |
| CN | 111895144 | A | | 11/2020 |
| CN | 212718193 | U | * | 3/2021 |
| CN | 114802661 | A | | 7/2022 |
| EP | 2924231 | A1 | | 9/2015 |
| GB | 1600095 | A | | 10/1981 |
| JP | H0536432 | A | | 2/1993 |
| SU | 887357 | A1 | | 12/1981 |

* cited by examiner

PRESSURE-RESISTANT CABIN FOR DEEP-SEA MOBILE OPERATION APPARATUS, UNDERWATER MINING VEHICLE, AND UNDERWATER MOBILE ROBOT

TECHNICAL FIELD

The present invention relates to an underwater mobile operation device, and in particular, to a pressure cabin for a deep-sea mobile operation device, an underwater mining vehicle, and an underwater mobile robot.

BACKGROUND ART

At present, devices used in the field of deep-sea operations are affected by an external pressure applied to the devices by seawater. Many operating environments in the fields of deep-water mining, combustible ice, and ocean engineering require a device (such as a mining vehicle) to operate on a seabed, and operations mostly need to be performed at a water depth of 5000-6500 meters. As a result, the device has to be provided with a housing strong enough to withstand the seawater pressure, or to achieve a balance between internal and external pressures by mounting a pressure compensator structure and being filled with a liquid.

In the first method, a greater strength and thickness of the housing of the device is required, which significantly increases the weight and size of the device. In addition, full pressure resistance is required for sealing, and technical requirements and difficulties in implementation are great. The overweight of the device means that an underwater mobile device is bulky, buoyancy compensation requirements are increased, and the difficulty in lowering and withdrawing is increased.

In the second method, requirements for sealing and a pressure resistance level of the housing are lowered, but it is required that parts and electrical elements used inside the device can withstand the same external pressure at a water depth. At present, underwater devices or parts produced by mainstream manufacturers in the world generally may withstand a pressure level at a water depth of about 4000 meters. Beyond this level, an industrial chain is not perfect, and related device components need to be customized and are expensive. In addition, customized devices further have the shortcomings of difficulties in ensuring a delivery date and quality, which is not conducive to industrial production.

SUMMARY

In view of this, against the technical problem to be solved by the present invention, a pressure cabin for a deep-sea mobile operation device, an underwater mining vehicle, and an underwater mobile robot are provided, to solve the problems that underwater pressure-resistant components in the field of deep-water operation engineering have an insufficient pressure bearing level and it is difficult to purchase the components, or that an extremely thick pressure cabin causes a too high weight of a mobile device and difficulty in movement thereof.

The present invention is provided to solve the above technical problems. An aspect of the present invention provides a pressure cabin for a deep-sea mobile operation device, the pressure cabin being applied to an environment at 3500-7000 meters underwater and comprising:

a first chamber and a second chamber that are sealed, wherein the first chamber is configured to accommodate electrical functional components of the mobile operation device, the second chamber is configured to arrange pressure compensators, and the first chamber and the second chamber are in communication with each other through a pipeline controlled by a solenoid valve;

the first chamber and the second chamber each are filled with a liquid insulating material;

a housing of the first chamber is of a pressure-resistant metal structure, and has a pressure load of 35 Mpa; and the pressure compensators in the second chamber adjust an internal pressure of the second chamber based on a depth of the device submerging in water, and when the solenoid valve of the first chamber is open, the pressure in the first chamber in communication with the second chamber through the pipeline can also be adjusted accordingly.

Another aspect of the present invention provides an underwater mining vehicle, which is provided with a pressure cabin for a deep-sea mobile operation device described above, an operation unit, and a track moving assembly, the track moving assembly being configured to drive the mining vehicle to move underwater under power drive of the mining vehicle.

A further aspect of the present invention provides an underwater mobile robot, which is provided with a pressure cabin for a deep-sea mobile operation device described above, and further comprises a manipulator, wherein the manipulator is controlled by a hydraulic control valve bank and a hydraulic/electric propeller control unit arranged inside a first chamber to perform a mechanical activity.

The pressure cabin for a deep-sea mobile operation device, the underwater mining vehicle, and the underwater mobile robot according to embodiments of the present invention have at least the following advantages.

1. Beyond a limitation of a conventional deep-sea water depth scale, the overall weight and size of the mobile operation device can be smaller than those of other devices bearing pressure only by means of housings while the strength of the housing of the pressure cabin remains unchanged, and the volume of buoyancy compensation and the difficulty in lowering/withdrawing can be reduced.

2. Since the first chamber only needs to bear a limited external pressure (pressure difference), the sealing difficulty of the pressure cabin is reduced and the reliability thereof is improved.

3. General pressure-resistant parts can be used in the pressure cabin of the present invention and applied in high-pressure working environments, with no need to customize special pressure-resistant parts used in ultra-deep water, which reduces a supply cycle and costs. Reliability of mass-produced part products can be improved, and the problem that it is difficult to purchase parts of a device operating in ultra-deep water is effectively solved.

4. When deployed on the underwater mobile operation device, the pressure cabin can adjust a balance pressure at any time with the underwater operation device at different water depths in one operation, thereby achieving wider applicability.

5. When the device operates in a region at a small water depth, the internal pressure of the first chamber of the device cabin can be reduced by means of an active pressure adjusting unit assembly, thus prolonging service lives of pressure-resistant components.

6. During device overhaul and testing, the internal pressure of the first chamber can be directly increased by means of an active pressure adjusting unit assembly to 35 Mpa for a pressure test, with no need to test functions and availability of the pressure cabin by means of other devices such as an external pressure cabin. During offshore operations, overhauling resources are saved, and time costs are reduced.

Figure 1:
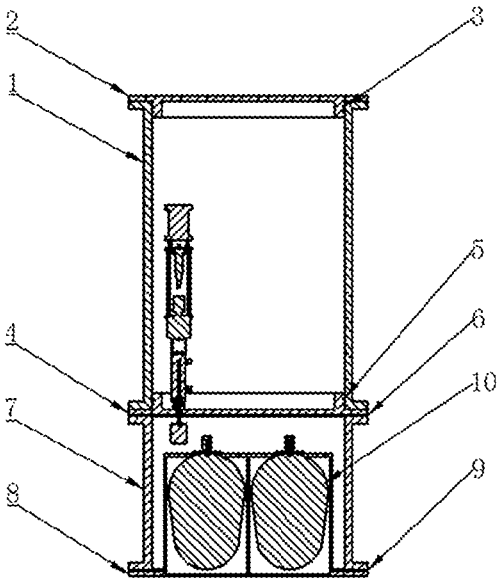
FIG. 1 is a schematic structural sectional view of a pressure cabin for a deep-sea mobile operation device according to an embodiment of the present invention.

1—Housing of first chamber
2—End cap of first chamber
3—Seal of first chamber
4—Partition
5—Seal of first chamber
6—Seal of second chamber
7—Housing of second chamber
8—End cap of second chamber
9—Seal of second chamber
10—Pressure compensator
11—Breathing baffle of pressure compensator
12—Oil inlet filter
13—Solenoid valve integrated block
14—Oil outlet filter
15—First solenoid valve
16—Second solenoid valve
17—Booster pump oil inlet filter
18—Booster pump assembly
19—Withstand pressure sensor
20—Electronic control unit

DETAILED DESCRIPTION OF EMBODIMENTS

To make the technical problems to be solved by the present invention, the technical solutions and beneficial effects of the present invention clearer, the present invention is further described in detail below with reference to the accompanying drawings and embodiments. It is to be understood that the specific embodiments described herein are merely illustrative of the present invention and are not intended to limit the present invention.

In the present application, referring to a state of a device in normal use, the words indicating a relative position relationship, such as up, down, top, bottom, inner and outer, are defined.

An aspect of the present invention provides a pressure cabin for a deep-sea mobile operation device, the pressure cabin being applied to an environment at 3500-7000 meters underwater and comprising: a first chamber and a second chamber that are sealed, wherein the first chamber is configured to accommodate electrical functional components of the mobile operation device, the second chamber is configured to arrange pressure compensators, and the first chamber and the second chamber are in communication with each other through a pipeline controlled by a solenoid valve; the first chamber and the second chamber each are filled with a liquid insulating material; a housing of the first chamber is of a pressure-resistant metal structure, and the housing made of a pressure-resistant metal has a pressure load of 35 Mpa; and the pressure compensators in the second chamber adjust an internal pressure of the second chamber based on a depth of the device submerging in water, and when the solenoid valve of the first chamber is open, the pressure in the first chamber in communication with the second chamber through the pipeline can also be adjusted accordingly. The housing of the pressure cabin can operate in an underwater environment as deep as 7000 meters by means of a pressure bearing capacity of 35 Mpa (usually requiring a pressure resistance level of 70 Mpa), and the electrical functional component in the pressure cabin only needs to have a common pressure resistance level of no more than 35 Mpa, thus achieving dual benefits of a moderate thickness of the pressure cabin and a low purchase cost of electrical functional components.

In an embodiment, an active pressure adjusting unit assembly is further arranged inside the first chamber, is connected to the solenoid valve, and is configured to adjust a magnitude of a compensatory pressure from the second chamber to the first chamber.

In an embodiment, the active pressure adjusting unit assembly comprises a pressure measurement and control unit and a micro booster pump.

In an embodiment, the electrical functional components arranged inside the first chamber comprise one or more of a pressure sensor, temperature sensor, a flow meter, a hydraulic control valve, a reversing valve, a hydraulic motor drive, and an electronic control unit.

In an embodiment, a electrical functional component arranged inside the first chamber is a pressure-resistant component, which has a pressure bearing capacity of no more than 35 Mpa, such as 30-35 Mpa.

In an embodiment, at least two pressure compensators are provided as the redundancy of the other.

In an embodiment, the active pressure adjusting unit assembly further comprises a hydraulic pipeline and a solenoid valve integrated block, which are connected to the solenoid valve.

In an embodiment, the active pressure adjusting unit assembly pressurizes an interior of the pressure cabin to be less than or equal to 35 Mpa before the pressure cabin enters water.

Another aspect of the present invention provides an underwater mining vehicle, which is provided with a pressure cabin for a deep-sea mobile operation device according to any one of the implementations described above, an operation unit, and a track moving assembly, the track moving assembly being configured to drive the mining vehicle to move underwater under power drive of the mining vehicle.

A further aspect of the present invention provides an underwater mobile robot, which is provided with a pressure cabin for a deep-sea mobile operation device according to any one of the implementations described above, and further comprises a manipulator, wherein the manipulator is controlled by a hydraulic control valve bank and a hydraulic/electric propeller control unit arranged inside a first chamber to perform a mechanical activity.

Various aspects of the present application are specifically described below with reference to the accompanying drawings.

Figure 2:
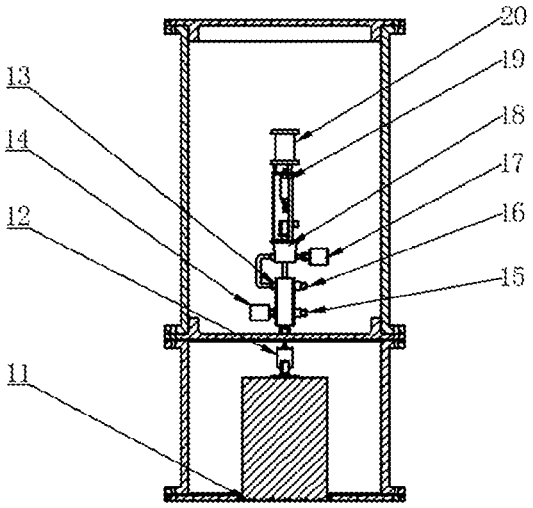
FIG. 2 is a schematic structural sectional view of the pressure cabin for a deep-sea mobile operation device shown in FIG. 1, as viewed from a different perspective.

A pressure cabin for a deep-sea mobile operation device shown in FIGS. 1 and 2 is applied in an environment at 3500-7000 meters underwater, and comprises an upper portion and a lower portion. After the pressure cabin is assembled, the upper portion is a first chamber, and the lower portion is a second chamber. A partition 4 is arranged between the first chamber and the second chamber. The partition 4 is hermetically connected to a housing 1 of the first chamber and a housing 7 of the second chamber. A top of the first chamber is hermetically fixed to the housing 1 of the first chamber by means of an end cap 2 of the first chamber, and a bottom of the second chamber is hermetically and fixedly connected to the housing 7 of the second chamber by means of an end cap 8 of the second chamber. The two chambers each are filled with a silicone oil. At least two pressure compensators 10 are further mounted inside the second chamber. A hydraulic pipeline, a solenoid valve integrated block 13, a booster pump assembly 18, a withstand pressure sensor 19 and an electronic control unit 20 are provided inside the first chamber. A first solenoid valve 15 and a second solenoid valve 16 being arranged on the solenoid valve integrated block 13. A booster pump oil inlet filter 17 and an oil outlet filter 14 are arranged on the booster pump assembly 18. A booster pump actively adjusts an internal pressure of a first chamber by means of oil inlet or oil outlet control. The solenoid valves enable the first chamber to be or not to be in communication with the second chamber, and an active pressure adjusting unit assembly composed of the pressure measurement and control unit, the micro booster pump and the solenoid valve achieves active adjustment of the internal pressure of the first chamber and seal detection.

The housing 1 of the first chamber is made of a pressure-resistant and corrosion-resistant metal, and can withstand a maximum external pressure load or an internal pressure or a difference between internal and external pressures of 35 Mpa by means of sealing by the end cap and the strength of the housing itself. Other electrical functional components needed for underwater operations, such as the pressure-temperature sensor, the flow meter, the hydraulic control valve, the reversing valve and the electronic control unit, are placed inside the first chamber. The electrical functional components in the first chamber each have a limited pressure bearing capacity, with a pressure bearing level between 3000-3500 meters underwater, but can be adapted to an operating environment at 7000 meters underwater, thereby effectively reducing the difficulty in purchasing parts and lowering purchase costs. The pressure compensators arranged inside the second chamber impart the chamber the ability to reach a balance with the external pressure, and can synchronously conduct the external seawater pressure to the second chamber during submerging of the device, to achieve the same internal and external pressure, so that the difference between the internal and external pressures is kept below 35 Mpa when the pressure cabin is at 7000 meters underwater, and the pressure cabin itself and the internal electrical functional components are within a normal pressure-bearing design range. Two or more pressure compensators are arranged inside the second chamber, so that when one pressure compensator is damaged, the other pressure compensator can serve the same function, thereby improving the safety of the device and lowering a maintenance rate.

In order to ensure that the pressure in the first chamber does not exceed the pressure resistance level of the device itself, an active pressure adjusting unit assembly is further arranged inside the first chamber, and the internal pressure of the pressure-resistant chamber can be adjusted by this unit.

The following aspects can be achieved by means of the active pressure adjusting unit assembly.

1. Pressure resistance and sealing functions of the first chamber can be verified. After the device is successfully integrated and manufactured, the pressure in the first chamber is increased to a design pressure by using the booster pump in the first chamber, and then pressure resistance and sealing performances are tested. In addition, a sealing performance of a compensation chamber (the second chamber) can be measured. For inspection and maintenance of the device, the pressure resistance and sealing functions of the first chamber can also be verified by means of the active pressure adjusting unit assembly, without performing special external pressure cabin inspection.

2. The device submerges after the first chamber is pre-pressurized (or without pressurization), and the pressure balance between the second chamber and external seawater is achieved through skin contraction of the pressure compensators in the second chamber. The pressure difference between the external seawater and each of the first chamber and the second chamber is kept within a design permission range.

3. When the device submerges with no pressure in the first chamber, the solenoid valve is controlled to be opened by means of the active pressure adjusting unit assembly to communicate the first chamber and the second chamber, so that the pressure in the first chamber is balanced with the pressure of the external seawater, and the valve is closed when the internal pressure of the first chamber reaches a designed pressure level or a target pressure.

4. When the device reaches a target operating water depth, the internal pressure of the first chamber is a design bearing pressure, and the overall structure and seal of the pressure cabin bear a differential pressure between the external pressure at the water depth and the pressure in the first chamber.

5. When the operating water depth of the device changes so that the external pressure is less than the pressure in the first chamber or the pressure in the first chamber does not need to be maintained at a design pressure, the pressure in the first chamber is adjusted to balance with the pressure in the second chamber by jogging the solenoid valve.

A use process of the pressure cabin for a deep-sea mobile operation device according to the present invention is as follows.

1. Pre-pressurization before the device enters water: before the device enters the water, the second solenoid valve 16 of the solenoid valve integrated block 13 is opened so that the second chamber is in communication with an oil inlet of the booster pump assembly 18, and after an underwater operating depth and a pressure resistance limit value of the first chamber are calculated, the booster pump assembly 18 is started to increase the pressure in the first chamber to the target pressure; and when the pressure reaches the target pressure, the device can be put into the water and submerge to an expected underwater operation location to start operations.

2. Synchronous pressure balance as the device submerges: before the device enters the water, the first solenoid valve 15 of the solenoid valve integrated block 13 is opened such that the second chamber is in communication with the first chamber, and with this state maintained, the device is put into the water to start submerging; the pressure of the water on the device increases with an increasing submerging depth during submerging; due to the existence of skins of the pressure compensators 10, the external water pressure is conducted to the second chamber, and as the second chamber is in communication with the first chamber in this case, the external water pressure can be synchronously conducted to the first chamber; and when the pressure in the first chamber reaches a bearing pressure limit, the first solenoid valve 15 of the solenoid valve integrated block 13 is closed to isolate the second chamber from the first chamber. Then the device continues to submerge to an expected underwater operation place for operations.

3. Pressure adjustment of underwater mobile operations: when the device completes operations at one operation location and then needs to move to another operation place at a different water depth for operations, the pressure change in bearing pressure can be controlled by switching on/off of the solenoid valve integrated block 13, and whether pressure adjustment in this case is achieved by means of the second chamber or the booster pump assembly 18 can be determined according to an actual situation.

The above functions and control manners are all achieved by the electronic control unit 20, and the pressure sensor 19 is mounted in the first chamber, and is configured to measure the internal pressure of the first chamber and give a control signal according to a set program.

In an embodiment, the underwater mobile operation device is an underwater mining vehicle, which is provided with a track moving assembly, and the underwater mining vehicle is moved under the action of the track moving assembly. The underwater mining vehicle is further provided with necessary components required for mining, such as a bearing platform, an ore collection tank, and a crushing device. Electrical control components, such as a hydraulic motor drive, a pressure/temperature/flow sensor, and a hydraulic control valve, are arranged in the pressure cabin.

In an embodiment, the underwater mobile operation device is an underwater mobile robot, which comprises a manipulator, and a hydraulic control valve bank and a hydraulic/electric propeller control unit that are arranged in the pressure cabin to drive the manipulator.

The preferred embodiments of the present invention are described above with reference to the accompanying drawings, but the scope of claims of the present invention is not limited thereby. Those skilled in the art may implement the present invention in many variation solutions without departing from the scope and essence of the present invention. For example, features of one embodiment may be used in another embodiment to obtain a further embodiment. Any modification, equivalent replacement and improvement made within the technical conception of the present invention shall fall within the scope of claims of the present invention.

INDUSTRIAL APPLICABILITY

The pressure cabin for a deep-sea mobile operation device, the underwater mining vehicle, and the underwater mobile robot according to embodiments of the present invention have at least the following advantages.

1. Beyond a limitation of a conventional deep-sea water depth scale, the overall weight and size of the mobile operation device can be smaller than those of other devices bearing pressure only by means of housings while the strength of the housing of the pressure cabin remains unchanged, and the volume of buoyancy compensation and the difficulty in lowering/withdrawing can be reduced.

2. Since the first chamber only needs to bear a limited external pressure (pressure difference), the sealing difficulty of the pressure cabin is reduced and the reliability thereof is improved.

3. General pressure-resistant parts can be used in the pressure cabin of the present invention and applied in high-pressure working environments, with no need to customize special pressure-resistant parts used in ultra-deep water, which reduces a supply cycle and costs. Reliability of mass-produced part products can be improved, and the problem that it is difficult to purchase parts of a device operating in ultra-deep water is effectively solved.

4. When deployed on the underwater mobile operation device, the pressure cabin can adjust a balance pressure at any time with the underwater operation device at different water depths in one operation, thereby achieving wider applicability.

5. When the device operates in a region at a small water depth, the internal pressure of the first chamber of the device cabin can be reduced by means of an active pressure adjusting unit assembly, thus prolonging service lives of pressure-resistant components.

6. During device overhaul and testing, the internal pressure of the first chamber can be directly increased by means of an active pressure adjusting unit assembly to 35 Mpa for a pressure test, with no need to test functions and availability of the pressure cabin by means of other devices such as an external pressure cabin. During offshore operations, overhauling resources are saved, and time costs are reduced.

Therefore, the pressure cabin has industrial applicability.

The invention claimed is:

1. A pressure-resistant cabin for a deep-sea mobile operation apparatus, the pressure-resistant cabin being applied to an environment at 3500-7000 meters underwater and comprising:

a first chamber and a second chamber that are sealed, wherein the first chamber and the second chamber each are filled with a liquid insulating material;

a housing of the first chamber is of a pressure-resistant metal structure, and has a pressure load of 35 Mpa; the first chamber is configured to accommodate electrical functional components of the mobile operation apparatus, and the electrical functional components have a pressure resistance level of no more than 35 Mpa;

the second chamber is configured to arrange pressure compensators, and the pressure compensators synchronously conduct an external seawater pressure into the second chamber during submerging of the apparatus;

the first chamber and the second chamber are in communication with each other through a pipeline controlled by a solenoid valve;

an active pressure adjusting unit assembly is further arranged inside the first chamber, is connected to the solenoid valve, and is configured to measure a pressure in the first chamber and control and adjust a magnitude of a compensatory pressure from the second chamber to the first chamber; and the pressure compensators in the second chamber adjust an internal pressure of the second chamber based on a depth of the apparatus submerging in water, and when the solenoid valve of the first chamber is open, the pressure in the first chamber in communication with the second chamber through the pipeline is also adjusted accordingly.

2. The pressure-resistant cabin for a deep-sea mobile operation apparatus according to claim 1, wherein the active pressure adjusting unit assembly comprises a pressure measurement and control unit and a micro booster pump.

3. The pressure-resistant cabin for a deep-sea mobile operation apparatus according to claim 1, wherein the electrical functional components arranged inside the first chamber comprise one or more of a pressure sensor, temperature sensor, a flow meter, a hydraulic control valve, a reversing valve, a hydraulic motor drive, and an electronic control unit.

4. The pressure-resistant cabin for a deep-sea mobile operation apparatus according to claim 1, wherein at least two pressure compensators are provided as the redundancy of the other.

5. The pressure-resistant cabin for a deep-sea mobile operation apparatus according to claim 1, wherein a hydraulic pipeline and a solenoid valve integrated block are provided inside the first chamber and are connected to the solenoid valve.

6. The pressure-resistant cabin for a deep-sea mobile operation apparatus according to claim 1, wherein the active pressure adjusting unit assembly pressurizes an interior of the pressure-resistant cabin to be less than or equal to 35 Mpa before the pressure-resistant cabin enters the water.

7. The pressure-resistant cabin for a deep-sea mobile operation apparatus according to claim 1, wherein the solenoid valve comprises a first solenoid valve; when the apparatus enters the water in a synchronous submergence and pressure balance manner, the first solenoid valve is opened before the apparatus enters the water, such that the second chamber is in communication with the first chamber, the pressure compensators in the second chamber adjust the internal pressure of the second chamber based on the depth of the apparatus submerging in the water, and the pressure in the first chamber in communication with the second chamber through the pipeline is also adjusted accordingly, and the first solenoid valve is closed when the internal pressure of the first chamber reaches a pressure limit.

8. The pressure-resistant cabin for a deep-sea mobile operation apparatus according to claim 1, wherein the solenoid valve comprises a second solenoid valve; when the apparatus enters the water in a pre-pressurized manner, before the apparatus enters the water, the second solenoid valve is opened such that the second chamber is in communication with an oil inlet of an active pressure adjusting unit, the pressure of the first chamber is increased to a target pressure, and the apparatus submerges to an expected underwater operation location.

9. An underwater mining vehicle provided with a pressure-resistant cabin for a deep-sea mobile operation apparatus according to claim 1, an operation unit, and a track moving assembly, the track moving assembly being configured to drive the mining vehicle to move underwater under power drive of the mining vehicle.

10. An underwater mobile robot provided with a pressure-resistant cabin for a deep-sea mobile operation apparatus according to claim 1 and further comprising a manipulator, wherein the manipulator is controlled by a hydraulic control valve bank and a hydraulic/electric propeller control unit arranged inside a first chamber to perform a mechanical activity.

* * * * *